US006401762B1

(12) United States Patent
Peeters

(10) Patent No.: US 6,401,762 B1
(45) Date of Patent: Jun. 11, 2002

(54) REED AND REED DENT FOR WEAVING MACHINES

(75) Inventor: Jozef Peeters, Ypres (BE)

(73) Assignee: Picanol N.V., Ypres (BE)

( * ) Notice: Subject to any disclaimer, the term of this patent is extended or adjusted under 35 U.S.C. 154(b) by 0 days.

(21) Appl. No.: 09/701,578

(22) PCT Filed: Jun. 9, 1999

(86) PCT No.: PCT/EP99/03976

§ 371 (c)(1),
(2), (4) Date: Dec. 11, 2000

(87) PCT Pub. No.: WO99/64654

PCT Pub. Date: Dec. 16, 1999

(30) Foreign Application Priority Data

| | | |
|---|---|---|
| Jun. 10, 1998 | (BE) | 9800446 |
| Sep. 4, 1998 | (BE) | 9800648 |
| Sep. 4, 1998 | (BE) | 9800649 |

(51) Int. Cl.[7] ..... D03D 49/62
(52) U.S. Cl. ..... 139/192
(58) Field of Search ..... 139/192

(56) References Cited

U.S. PATENT DOCUMENTS

| | | | | | |
|---|---|---|---|---|---|
| 4,457,344 | A | * | 7/1984 | Marti | 139/192 |
| 4,989,646 | A | * | 2/1991 | Nitta et al. | 139/192 |
| 6,019,139 | A | * | 2/2000 | Thompson, III | 139/192 |
| 6,102,081 | A | * | 8/2000 | Thompson, III | 139/192 |
| 6,135,161 | A | * | 10/2000 | Nakano et al. | 139/192 |

* cited by examiner

*Primary Examiner*—Andy Falik
(74) *Attorney, Agent, or Firm*—Bacon & Thomas, PLLC

(57) ABSTRACT

A reed (60) for a weaving machine. The reed includes juxtaposed reed dents (61), the ends of which are held in a lower profiled bar (62) and in an upper profiled bar (8). The reed dents in at least a sub-segment projecting from the lower profiled bar have a width of about 6 mm and in an upper segment exhibit a width of about 4 mm.

19 Claims, 8 Drawing Sheets

REED AND REED DENT FOR WEAVING MACHINES

BACKGROUND OF THE INVENTION

1. Field of the Invention

The present invention relates to a reed with a plurality of juxtaposed reed dents the ends of which are affixed in a lower profiled bar, hereafter broadly called lower U-channel, to be mounted on a batten beam, and in an upper profiled bar, hereafter broadly called upper U-channel.

2. Description of the Related Art

When reeds of the above kind are used in airjet looms, reed dents are used which include a U-shaped recess between their upper and lower segments defining a filling guide channel.

It was found in practice that high weaving rates, i.e. weaving rates of about 1,000 fillings a minute or more will produce streaks in the fabric which renders the fabric as irregular.

SUMMARY OF THE INVENTION

The objective of the present invention is to create a reed of the initially cited kind which shall be appropriate for high weaving rates.

This problem is solved in that the reed dents are provided with a width of about 6 mm at least in a segment extending from the lower profiled bar and a width of about 4 mm in their upper segment.

The invention is based on the insight that at high weaving rates the fabric streaks are caused by the reeds which, at such rates, will incur dynamic reed dent oscillations. The reed dents are comparatively rigid in their lower zone as a result of their widening at this zone and as a result flexure, especially at filling beatup, is reduced and thereby also the resulting oscillations of the reed dents.

On the other hand the upper, comparatively narrow segment which is farther from the axis of rotation of the batten, is lightweight, and inertial forces arising from the to-and-fro batten motion and acting on this reed dent segment and the resulting flexures and oscillations will remain small. Accordingly reed dent oscillations are restricted on account of their comparatively rigid lower segment and comparatively lightweight upper segment.

In one embodiment of the invention, the front edges of the lower and upper segments of the reed dents are at least approximately aligned with a beatup edge in the zone of the said recess. In this manner the reed designed with these reed dents can be used as an alternative to a conventional reed without entailing substantial changes in the loom.

In a further embodiment of the invention, the reed dents comprise a substantially straight edge running between the upper and lower profiled bars and located opposite the filling guide channel. This design offers the advantage that during assembly the reed dents can rest on this edge.

In a further embodiment of the invention, the reed dents have a wedge-shaped width, hereafter called tapering width, in that segment or segment portion where they enter into the lower or upper profiled bars, the cross-section of the lower and/or upper profiled bar matching said taper shape. This design of the invention offers the advantage that the outer contour of the lower profiled bar is not changed relative to conventional reeds and that it is very easy to use a reed of the invention as an alternative to conventional reeds without further changes in the loom. This design also allows forming reeds with comparatively wide reed dents having a straight front and rear edge which are recommended for high-rate weaving and/or to weave heavy fabrics. In this instance as well said wide reed dents can be used without entailing significantly changing the width of the lower profiled bar. In particular the same fasteners may be used to affix reeds having reed dents of different widths to the same batten beam.

Further features and advantages of the invention are elucidated in the description below and in relation to the embodiment shown in the drawing.

DETAILED DESCRIPTION OF THE PREFERRED EMBODIMENTS

Figure 1:
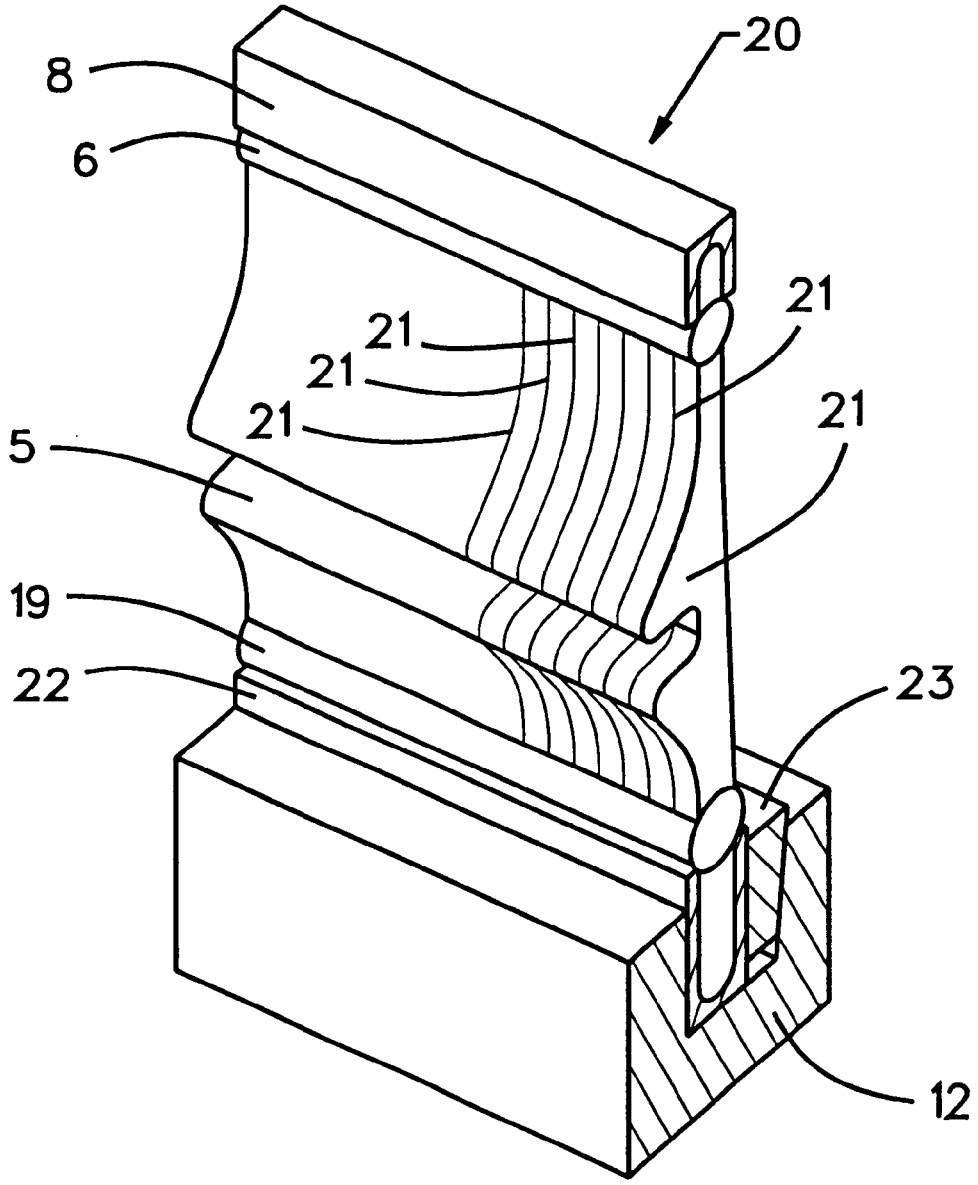
FIG. 1 is a perspective of a cutaway of a reed of the invention mounted to a batten beam.
Figure 2:
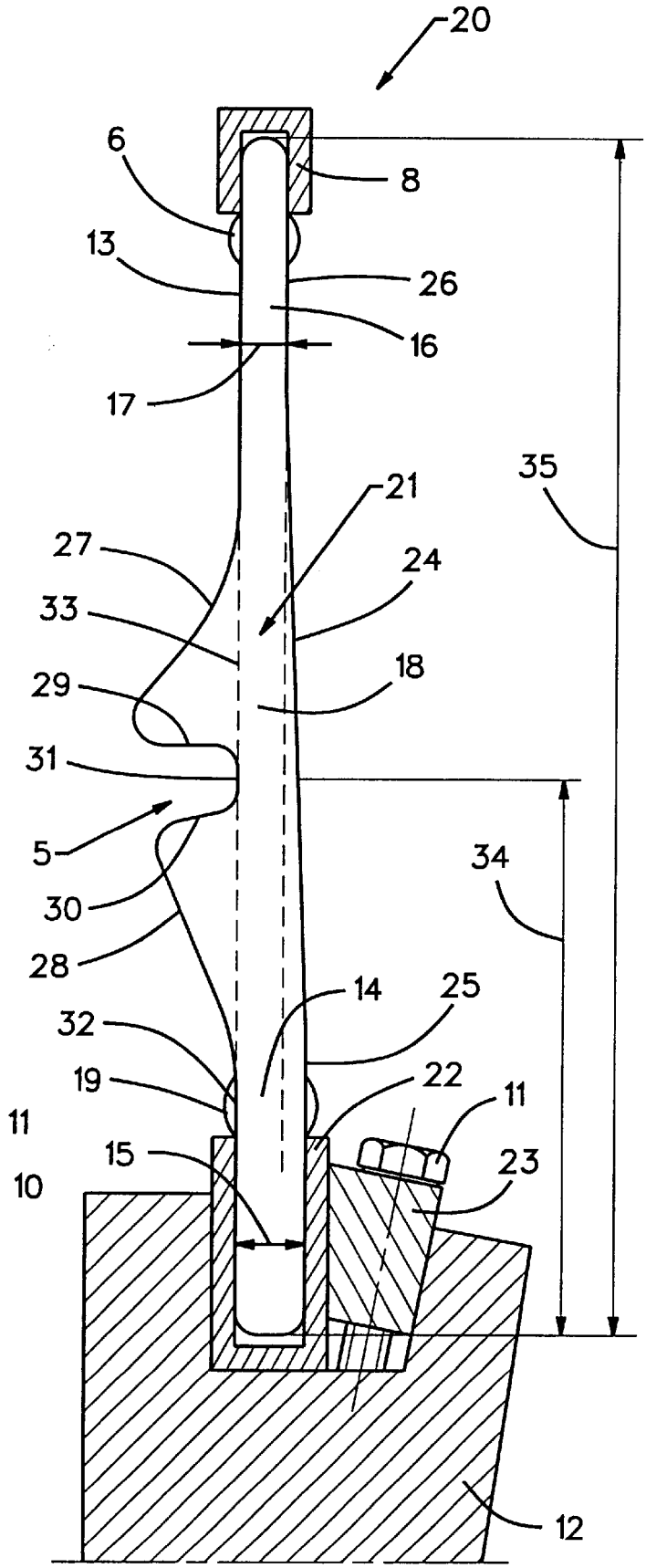
FIG. 2 is a cross-section of the reed of FIG. 1 shown on a larger scale.

The reed 20 shown in FIGS. 1 and 2 comprises a plurality of parallel adjacent reed dents 21. The reed dents 21 are fitted with a recess that defines a guide channel 5 to receive an inserted filling. At their upper and lower end zones, the reed dents 21 are kept apart from each other at a defined spacing by connecting spirals 6, 19 and are affixed at their upper and lower ends to upper and lower U-channels or cross-sectionally profiled bars 8 and 22 resp. The reed dents 21 are bonded both to the connecting spirals 6, 19 and the upper and lower Profiled bars 8 and 22. The lower Profiled bar 22 is affixed by a wedge 23 and screws 11 to a batten beam 12. The batten beam 12 is affixed in a known manner by batten arms spaced parallel with the batten beam shaft.

The reed dents 21 are formed as a substantially cross-sectionally rectangular lower segment 14 of which the width 15 is about 6 mm. This width is substantially larger than that of conventional reed dents, which is roughly only 4 mm.

The reed dents 21 also include a substantially cross-sectionally rectangular upper segment 16 of which the width is about 4 mm. The width of this segment is substantially the same as that of conventional reed dents. Moreover the reed dents 21 include a middle segment 18 formed with a U-shaped recess and connected the lower segment 14 and the upper segment 16. The middle segment 18 is fitted with an edge 24 which connects to the rear-side edge 26 of the upper segment 16 and to the rear-side edge 25 of the lower segment 14. The middle segment 18 is fitted at its front side with an upper, curved edge 27 merging into the front edge 13 of the upper segment 16. This curved edge 27 merges through a rounded part into the upper edge 29 of the recess subtending the guide channel 5. In similar manner a curved edge 28 adjoins the front edge 32 of the lower segment 14 and merges through a rounded element into the lower edge 30 of the recess subtending the guide channel 5. In the vicinity of the guide channel 5, the reed dents 21 form a beatup edge 31 which is aligned at line 33 with the front edge 13 of the upper segment 16 and the front edge 32 of the lower segment 14.

Besides the already mentioned advantages, the segment 14 having a width of about 6 mm furthermore offers the advantage that—compared with the conventional reed dents—the reed dents 21 are substantially thicker in the zone between the lower Profiled bar 22 and the beatup edge 31, as a result of which the danger that the reed dents 21 will break is less in this zone. Compared to conventional reed dents, the zone of the upper segment 16 is lengthened, whereas the curved edge 27 is shortened. In this manner the reed dent weight in the zone of this segment 16 has been reduced over that of conventional reed dents.

The middle of the beatup edge 31, which conventionally beats fillings against the fabric is situated a distance 34 of about 48 mm above the lower end of the reed dents 21. The distance 35 between the lower end and the upper end of the reed dents 21 is about 104 mm. In modified embodiments, this distance may be approximately between 94 and 104 mm.

Figure 3:
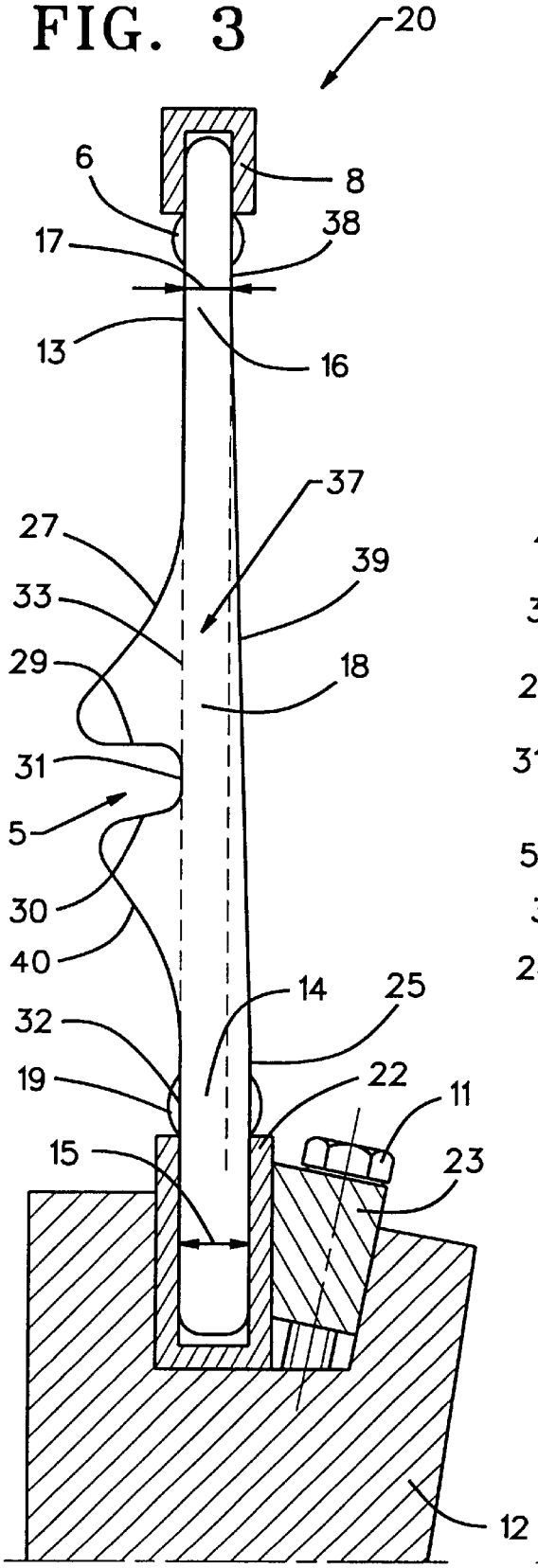
FIGS. 3–6 are sections similar or to that of FIG. 2 of different embodiments modes.
Figure 4:
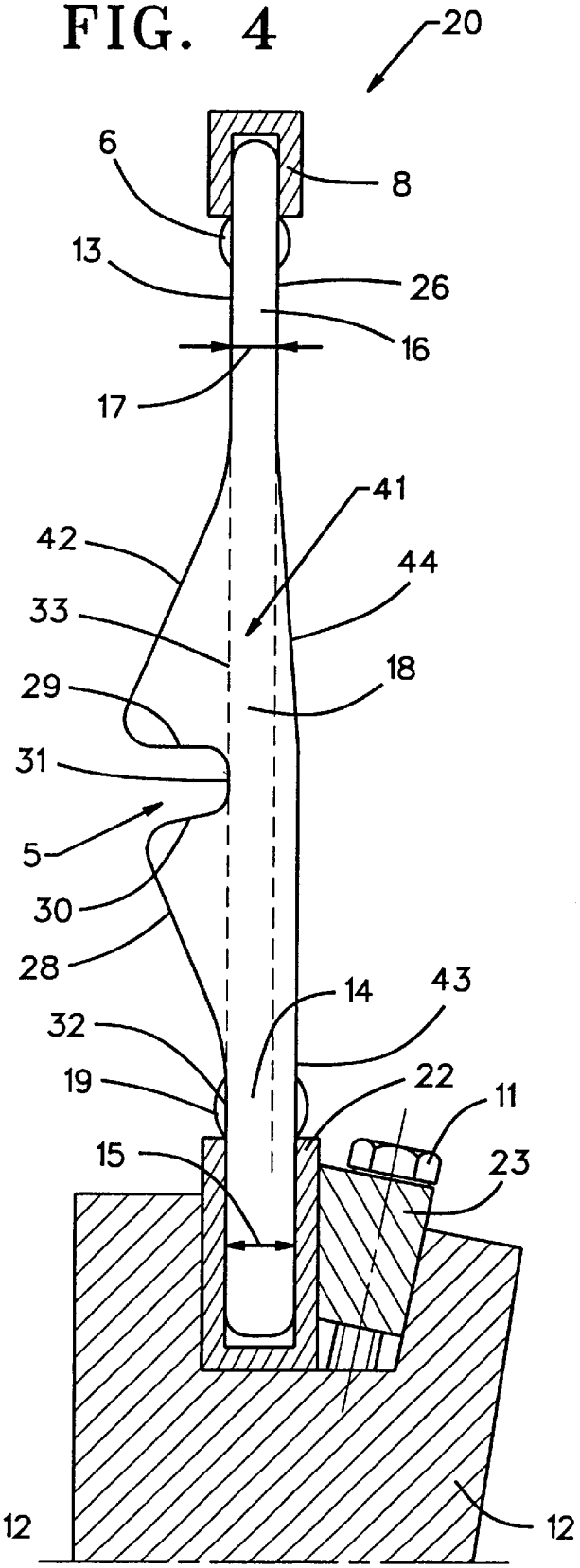

The reed dents shown in FIGS. 3 and 4 offer the same advantages as those of FIG. 2. The reed dent 37 of FIG. 3 is fitted in the upper segment 16 with a short and straight edge 38 which is linked by means of a comparatively long and straight edge 39 to the also straight and relatively short edge 25 of the lower segment 14. On the other hand, underneath the guide channel 5, there is another curved front edge which is shorter than the edge 28 of the embodiment of FIG. 2.

The reed dent 41 of FIG. 4 is fitted with an edge 42 above the channel 5 which is longer than the edge 27 of FIGS. 2 and 3 and corresponds approximately to the edges of conventional reed dents. At the rear side, the reed dents 41 are fitted with a straight and comparatively long edge 26 (similar to the case of FIG. 2) in the segment 16, and in the zone of the lower segment 14, they are fitted with a straight and relatively long edge 43. These two edges are linked in the zone above the guide channel by a straight and comparatively short edge 44. In this embodiment the weight of the reed dent 41 above the beatup edge 31 slightly exceeds that of the embodiment of FIGS. 2 or 3; however the width, and hence the mechanical strength of the reed dents 41, is larger between the lower U-channel 22 and the beatup edge 31.

Figure 5:
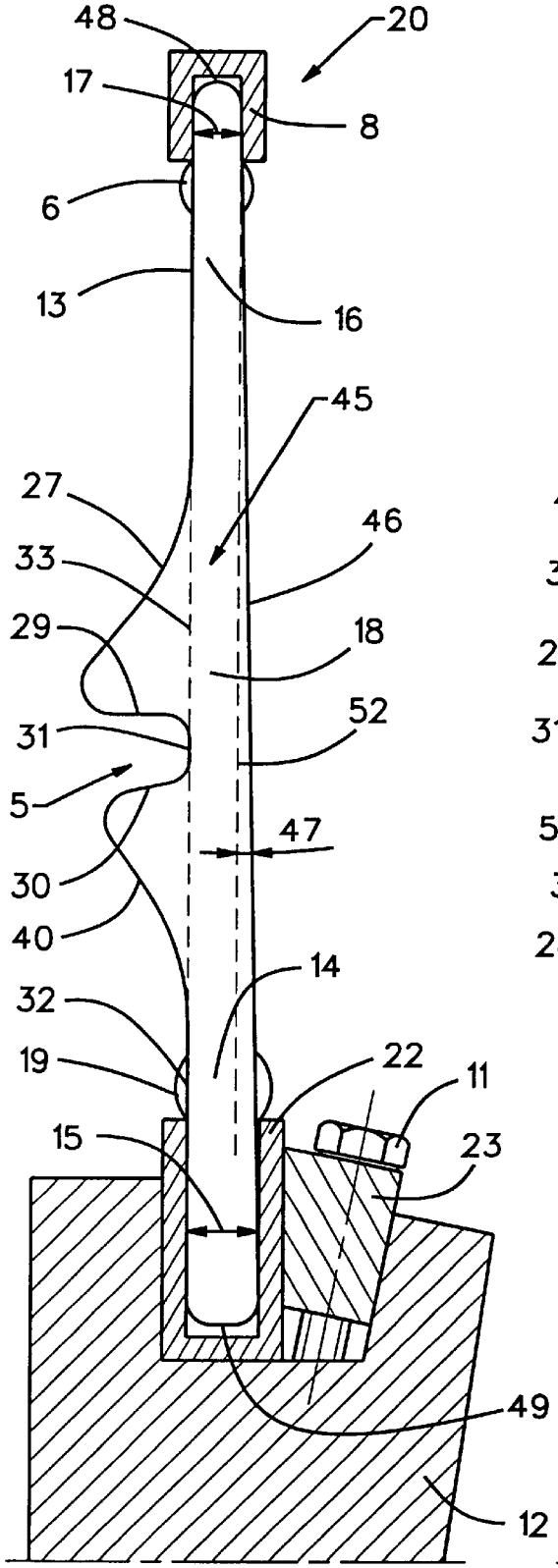

FIG. 5 shows a reed dent 45 of a design similar to that of the reed dent 37 in FIG. 3. however the rear-side edge 46 between the upper end 48 and the lower end 49 of the reed dents 45 is a straight line. The edge 46 subtends an angle 47 of about 1.15° with a line 52 which runs parallel to the line 33 that passes through the front edge 13 of the upper segment 16, the front edge 13 of the lower segment 14 and the beatup edge 31.

Figure 6:
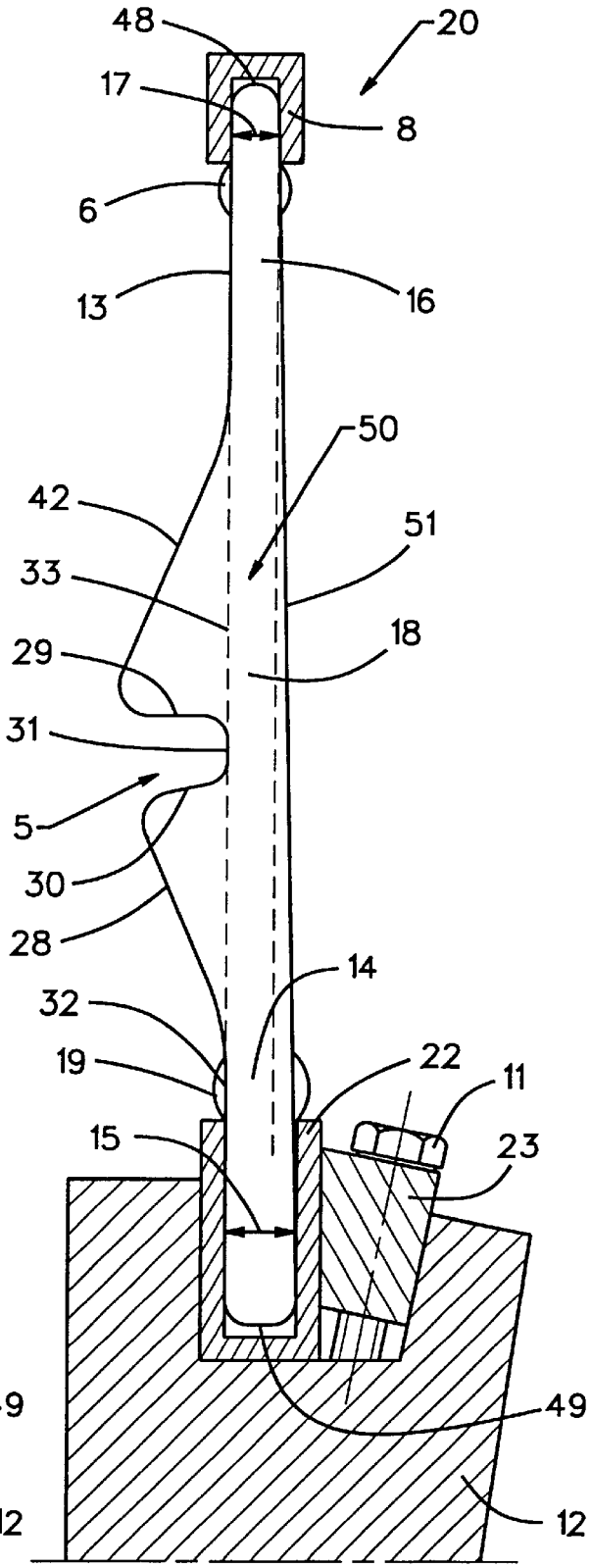

The reed dent 50 shown in FIG. 6 is similar to the reed dent 41 of FIG. 4, however in this case the rear-side edge 51 also extends along a straight line between the upper end 48 and the lower end 49 of the reed dents 50. In the vicinity of the upper U-channel, the reed dents 50 are formed as an approximately rectangular side surface of about 4 mm and in the zone of the lower U-channel a substantially rectangular segment 14 of a width 15 of approximately 6 mm.

Figure 7:
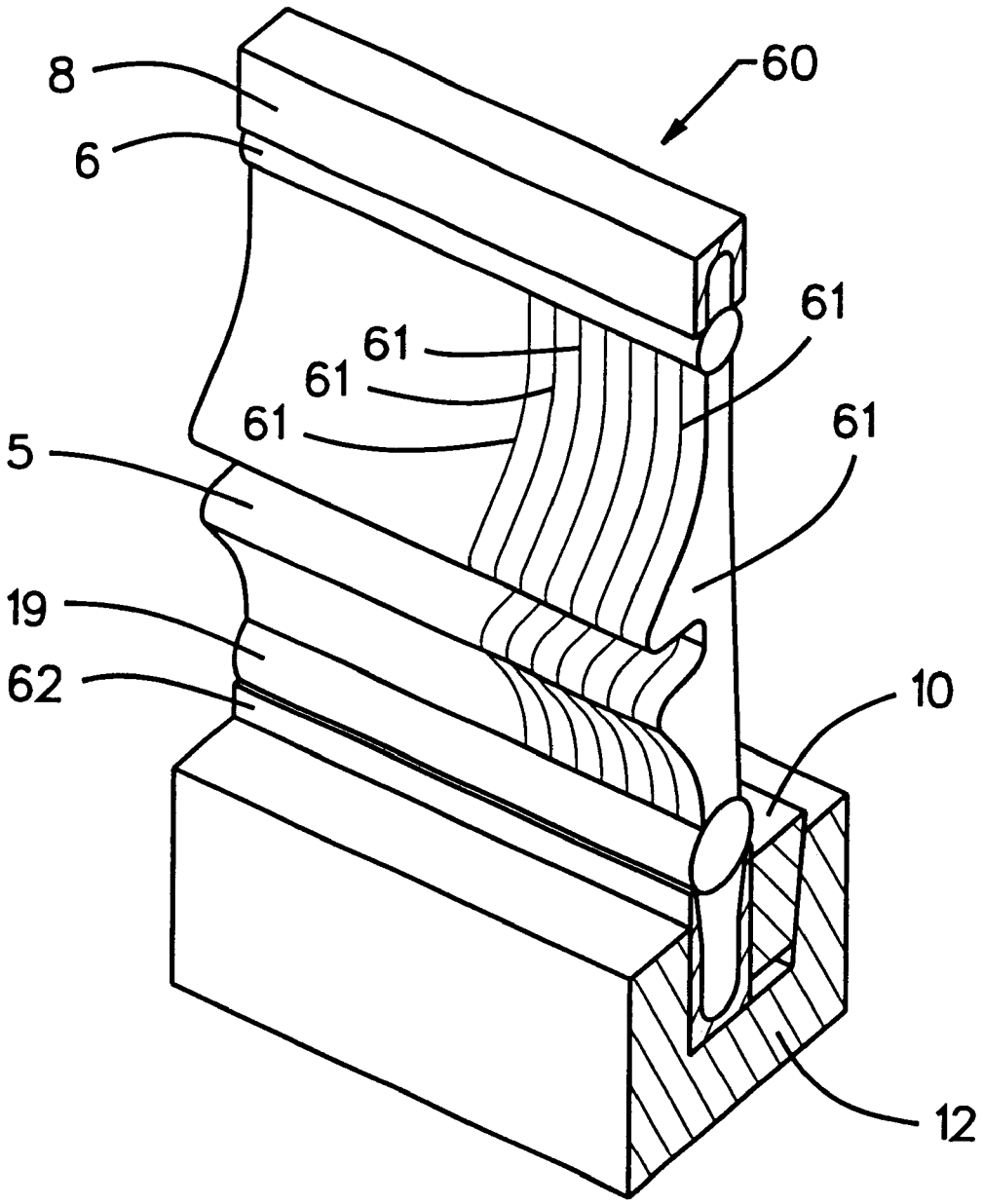
FIG. 7 is a perspective of a cutaway of a modified embodiment of a reed of the invention.
Figure 8:
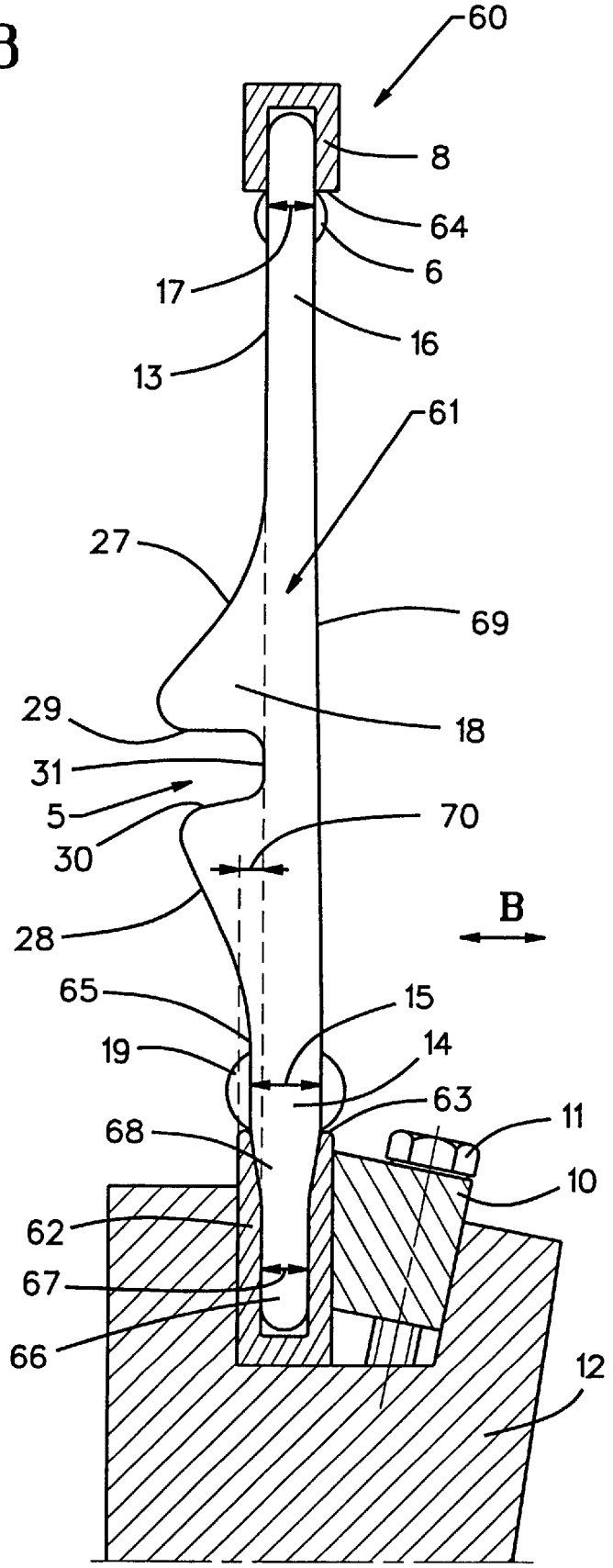
FIG. 8 is a cross-section of the reed of FIG. 7.

As regards the embodiment of FIGS. 7 and 8, the reed 60 comprises a plurality of reed dents 61 that are fitted with a rear edge 69 starting at the upper segment 16. In the zone of its front edge, the reed dents 61 are designed in the manner of the embodiment of FIG. 2. and that description may be referred to as needed. However the lower segment 14 is further divided into two sub-segments 66 and 68, the upper lower sub-segment 68 tapering from the upper edge 63 of the cross-sectional profile 62 toward the lower sub-segment 66. The width 67 of the lower sub-segment 66 is about 4 mm. The lower sub-segment 66 is adjoined within the lower cross-sectional profile 62 by the upper sub-segment 68 in the form of a wedge-shaped sub-segment 68 linking the lower sub-segment 66 with the segment 14 projecting from the lower U-channel. the width 15 of the segment 14 being about 6 mm. The front edge 65 of the lower segment 14 merges into the curved front edge 28. The front edge of the lower sub-segment 66 runs in alignment with the beatup edge 31 and the edge 13 of the upper segment. The front edge of the lower U-channel 62 is located at a distance 70 of about 2 mm from the edge 13. In this embodiment, the width of the U-channel profile 62 is practically identical with that of a conventional U-channel profile. The width of the lower U-channel is about 8 mm and as a result the same fasteners can be used as in conventional reeds, that is, a clamping strip 10 and screws 11 fastening the reeds to a batten beam 12. Because the beatup edge 31 of the reed 60, with reed dents 61, is situated in the same position as a beatup edge fitted with conventional reed dents, the reed 60 can replace a conventional one without thereby affecting the beatup position of the beatup edges of these reeds.

However, because the lower segment 14—that is, the segment 14 projecting from the upper edge 63 of the lower U-channel 62 of the reed dents 61—is of a width 15 of 6 mm, these reed dents 61 offer the same advantages already described in relation to the embodiments of FIGS. 2 through 6. The danger of streaks in the fabric is reduced at high weaving rates and simultaneously the danger of breaking the reed dents reduced.

Figure 9:
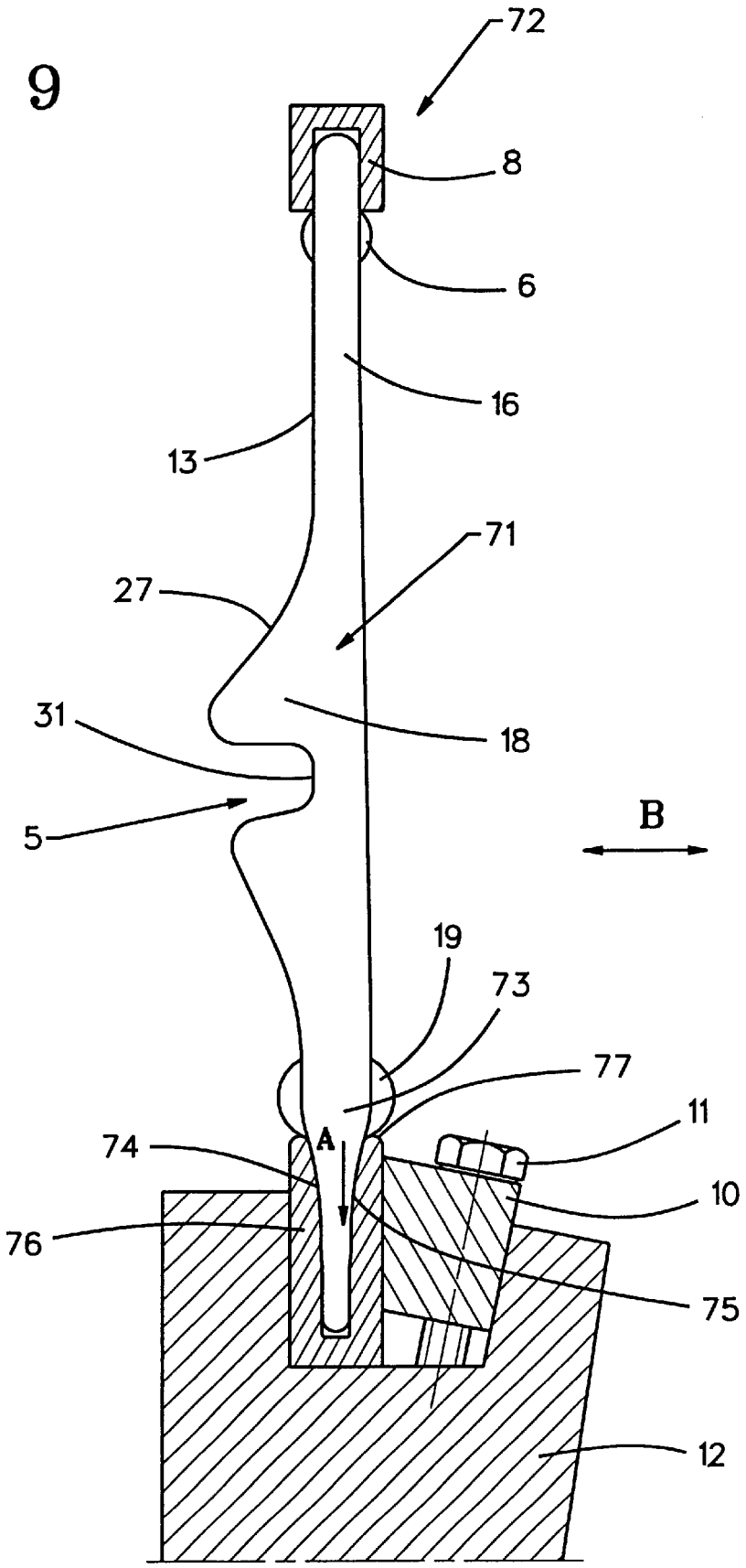
FIG. 9 is a section similar to that of FIG. 8 of a modified embodiment.

The design of the reed dents 71 of a reed 72 shown in FIG. 9 corresponds substantially with that of the reed dents 61 of the embodiment of FIG. 8. However they differ in the area of the lower segment 73 where they are affixed inside a lower U-channel profile 76. The lower segment 73 of the reed dents 71 has a width of about 6 mm in the direction of the arrow B at its portion projecting from the upper edge 77 of the U-channel profile 76. That portion within the U-channel of the segment 73 then tapers to a width of about 4 mm, the side edges 74, 75 first being curved and merging continuously into a substantially rectangular surface whereat the width is about 4 mm. The side walls of the lower U-channel 76 are contoured correspondingly and therefore only the lower U-channel 76 has outside dimensions corresponding to those of a lower U-channel of a conventional reed. The curved surfaces or side edges 74, 75 of the lower segment 73 extend approximately over ⅓ the height of the lower U-channel 76.

Figure 10:
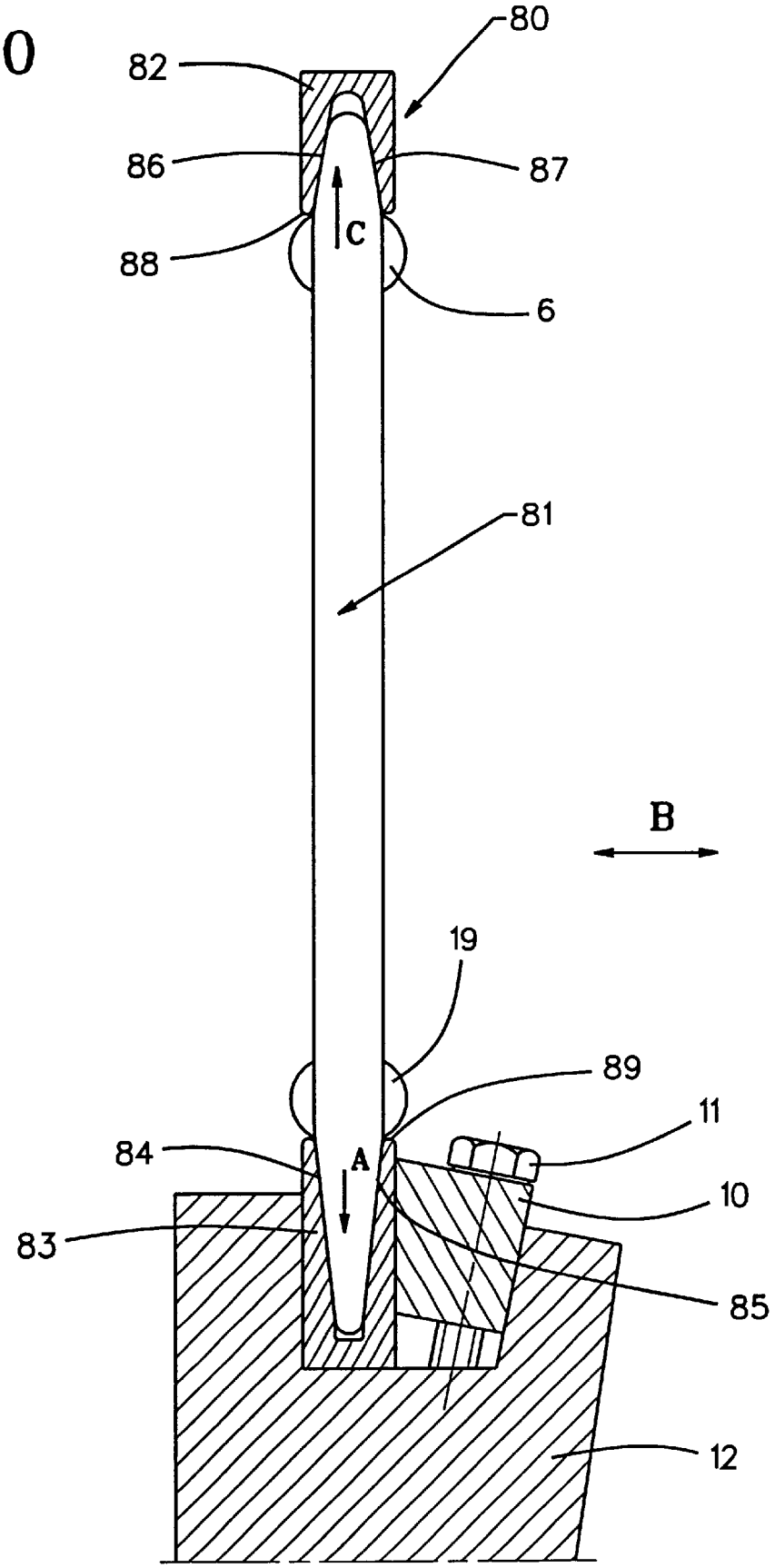
FIG. 10 is a section similar to that of FIG. 8 of a further embodiment of a reed of the invention.

The embodiment of FIG. 10 shows a reed 80 which also comprises juxtaposed reed dents 81. These reed dents are fitted with a middle segment extending at a constant width in the direction B of about 6 mm from an upper, tapering U-channel 82 to a lower, tapering U-channel 83. The lower end zone by which the reed dents 81 enter the lower, tapering U-channel 83 constricts in a tapering manner, both side edges 84, 85 being straight and tapering in the direction A toward the inside of the tapering U-channel 83. The outer contour of the lower tapering U-channel 83 or profiled bar corresponds to the outer contour of the lower profiled bar of a conventional reed, that is, its width is about 8 mm. As a result, this reed 80 may replace a conventional reed in the same batten beam 12 using the same fasteners 10, 11.

In order to be able to use a comparatively small tapering U-channel 82 also in the zone of the upper ends of the reed dents 81, the ends of the reed dents 81 run together in tapering manner in the direction C, and the two side edges 86. 87 of the reed dents 81 also extend straight. The inner contour of the upper tapering U-channel 82 matches in the same way the tapering ends of the reed dents 81. It follows therefore from FIG. 10 that the reed dents 81 have increased width within the segment between the lower edge 88 of the upper tapering U-channel 82 and the upper edge 89 of the lower tapering U-channel 83, for instance a width of 6 mm, whereas and foremost the lower tapering U-channel 83. and also the upper tapering U-channel 82, have an outer contour not larger than the corresponding U-channel of conventional reeds wherein the reed dents have a width in the direction B of only about 4 mm.

The invention also applies to reed dents having other shapes other than those shown above. Combinations of particular embodiments described also may be used for the reed dents and/or for the upper and lower U-channel or profiled bars. Because increase in mechanical strength is not sought in the zone of the upper U-channel, but instead weight reduction is, other shapes and in particular stepped shapes may be used for the inside contour of the upper profiled bars and for the upper ends of the reed dents.

The reed dents of the invention and their reeds are appropriate for airjet looms, gripper looms, waterjet looms and looms operated with other liquids, projectile looms, shuttle looms and other weaving machines.

The scope of the present invention is defined by the attached claims and also allows further modifications of the embodiments modes above that were described only in illustrative manner.

What is claimed is:

1. A reed comprising a plurality of juxtaposed reed dents (61,71,81) having ends held in a lower profiled bar (62,76, 83) securable to a batten beam (12) and in an upper profiled bar (8,82), the reed dents have a width of about 6 mm at least in a segment projecting from the lower profiled bar and a width of about 4 mm in an upper segment thereof;

said reed dents (61, 71, 81) having a tapered width in the segment wherein they enter the lower profiled bar (62, 74, 83), the inside cross-section of the lower profiled bar matching said tapered width.

2. The reed as claimed in claim 1, characterized in that the segment has a tapering width extending from the open side of the profiled bar (62, 76) over a length corresponding to about ½ to ⅓ the depth of the profiled bar, and in that said segment is adjoined by a sub-segment of lesser width and of substantially straight side surface.

3. A reed dent (61, 71, 81) for a reed (60, 72, 80) comprising an upper segment mountable in an upper profiled bar (8, 82) and a lower segment mountable in a lower profiled bar (62, 76, 84), characterized in that the lower segment has at least in its segment or sub-segment projecting from the lower profiled bar (62, 76, 83) a width of about 6 mm and wherein the upper segment's width is about 4 mm;

and wherein the lower segment (68, 73) has a tapering width in its sub-segment mountable in said lower profiled bar (62, 76, 83).

4. The reed dent as claimed in claim 3, characterized in that a terminal sub-segment having substantially a rectangular cross-section adjoins the sub-segment exhibiting a taper.

5. The reed dent as claimed in claim 4, wherein the length of the terminal sub-segment of substantially cross-sectionally rectangular shape is substantially the same as the length of the sub-segment at which the width decreases in wedge-shaped manner.

6. A reed comprising a plurality of juxtaposed reed dents (61, 71, 81) having ends adapted to be held in a lower profiled bar (62, 76, 83) securable to a batten beam (12) and in an upper profiled bar (8, 82), wherein the reed dents (61,71, 81) each have a tapered width in a lower segment thereof where it is adapted to enter a lower profiled bar.

7. The reed claimed in claim 6, wherein said lower profiled bar has an inside cross-section matching the tapered width of the lower segment and wherein the lower segment has a tapering width extending over a length corresponding to about ⅓ to ½ of a depth of the profiled bar, and in that said lower segment is adjoined by a sub-segment (66) of lesser width and having substantially straight side surfaces.

8. A reed dent (61, 71, 81) for a reed (60, 72, 80) comprising an upper segment mountable in an upper profiled bar (8, 82) and a lower segment mountable in a lower profiled bar (62, 76, 83), the lower segment (68, 73) having a tapering width in a sub-segment adapted to be insertable in a lower profiled bar (62, 76, 83).

9. The reed dent as claimed in claim 8, wherein a terminal sub-segment (66) having substantially a rectangular cross-section adjoins the sub-segment having a tapering width.

10. The reed dent as claimed in claim 9, wherein the terminal sub-segment having substantially a cross-sectional rectangular cross-section has a length that is substantially the same as the length of said sub-segment having a tapering width.

11. A reed comprising a plurality of juxtaposed reed dents (61,71,81) having ends held in a lower profiled bar (62,76, 83) securable to a batten beam (12) and in an upper profiled bar (82), the reed dents having a tapered width in a segment at which the reed dents enter the lower profiled bar, wherein the inside cross-section of the lower profiled bar matches said tapered width.

12. The reed claimed in claim 11, wherein said segment has tapering width extending from the open side of the profiled bar (62,76) over a length corresponding to about ⅓ to ½ the depth of the profiled bar, and in that said segment is adjoined by a sub-segment of lesser width and of substantially straight side surface.

13. A reed comprising a plurality of juxtaposed reed dents (21, 37, 41, 45, 50) having opposed ends held in a lower profiled bar (22) securable to a batten beam (12) and in an upper profiled bar (8); said reed dents each having a length between said ends and having a width between front and rear edges thereof of about 6 mm at least in a lower segment (14) projecting from the lower profiled bar and of about 4 mm in an upper segment thereof; said reed dents each further comprising a filling guide channel (5) in a middle segment (18), said channel defined by a transverse substantially U-shaped recess, and a beatup edge (31) provided in a bottom region of the recess; the front edges of the lower segment and the upper segment of each reed dent configured so they are aligned at least approximately with said beatup edge, the rear edge of each reed dent configured and located with respect to the front edge of the respective reed dent so as to define said 4 mm and 6 mm widths along the length of each reed dent.

14. A reed dent (21, 37, 41, 45, 50) for a reed (20) comprising an upper segment (16) including a portion mountable in an upper profiled bar (8) and a lower segment (14) including a portion mountable in a lower profiled bar (22); said reed dent having a length between opposed ends thereof, and having a width between front and rear edges thereof of about 6 mm at least in a portion of the lower segment that normally would project from a lower profiled bar when said portion of the lower segment of the dent is mounted in such bar, and of about 4 mm in the upper segment thereof; said reed dent further comprising a filling guide channel (5) in a middle segment (18) thereof defined by a transverse substantially U-shaped recess, and a beatup edge (31) provided in a bottom region of the recess; the front edges of the lower segment and the upper segment of the reed dent configured so they are aligned at least approximately with said beatup edge, the rear edge of the reed dent configured and located with respect to the front edge therof so as to define said 4 mm and 6 mm widths.

15. A reed as claimed in claim 13, said end held in the lower profiled bar having a rectangular shape and a width of about 6 mm within the lower profiled bar.

16. A reed as claimed in claim 13, said end held in the upper profiled bar having a rectangular shape and a width of about 4 mm within the upper profiled bar.

17. A reed as claimed in claim 13, said end held in the lower profiled bar having a rectangular shape and a width of about 6 mm within the lower profiled bar; said end held in the upper profiled bar having a rectangular shape and a width of about 4 mm within the upper profiled bar.

18. A reed as claimed in claim 13, wherein the rear edge (46, 50) of each reed dent is linear along the length of the reed dent between the ends held in the upper and lower profiled bars.

19. A reed dent as claimed in claim 14, wherein the rear edge (46, 50) of each reed dent is linear along the length of the reed dent between the portions of the upper and lower segments mountable in upper and lower profiled bars.

* * * * *